United States Patent [19]

Bishop

[11] Patent Number: 5,000,091

[45] Date of Patent: Mar. 19, 1991

[54] CONTACT INK STAMPING APPARATUS

[76] Inventor: Alva Bishop, 3750 Greenbriar Dr., Zanesville, Ohio 43701

[21] Appl. No.: 331,549

[22] Filed: Mar. 31, 1989

[51] Int. Cl.[5] ..... B41K 1/40

[52] U.S. Cl. ..... 101/334; 101/104

[58] Field of Search ..... 101/104, 105, 333, 334, 101/318

[56] References Cited

U.S. PATENT DOCUMENTS

| | | | |
|---|---|---|---|
| 3,797,390 | 3/1974 | Marozzi et al. | 101/334 |
| 3,804,016 | 4/1974 | Marozzi et al. | 101/3334 |
| 4,004,511 | 1/1977 | De Groot | 101/334 |
| 4,718,341 | 1/1988 | Bishop | 101/334 |

*Primary Examiner*—Edgar S. Burr
*Assistant Examiner*—C. A. Bennett
*Attorney, Agent, or Firm*—Francis T. Kremblas, Jr.

[57] ABSTRACT

An improved automatic contact ink stamping apparatus which is characterized by a multipart ink re-charging assembly which facilitates the changing of the supply of ink or the ink pad in a quick and easy manner without disturbing the fixed registration position between the ink assembly and the stamp mounting plate. The contact stamping apparatus disclosed in the type wherein the die stamp is reciprocated between an ink re-charging and a stamping position. The ink re-charging assembly includes a mounting bracket fixed to a support base of the apparatus which is conformed to removably receive an ink pad holder. The ink pad holder includes an ink pad which is positioned therein to engage the work surface of the die stamp when it is located in the re-charging position. The ink pad holder can be easily removed in a simple manner and replaced for any reason without removing and adjusting the registered and sealed initial position of the bracket relative to the die stamp.

4 Claims, 4 Drawing Sheets

CONTACT INK STAMPING APPARATUS

BACKGROUND ART

Ink stamping devices for various industrial and commercial applications having a variety of features are well-known in the prior art. Some of the applications for such devices include assembly line manufacturing processes wherein various parts and sub-assemblies produced in high volume require identifying markings, such as part numbers for example. Other applications include marking containers or boxes with certain indicia such as contents, production information, shelf life and the like.

Many of the automated ink marking devices are relatively complex and expensive, such as sophisticated printers and the like. A relatively low cost contact ink printer capable of high volume and clear strong imprints is disclosed in U.S. Pat. No. 4,718,341. Reliable high volume printers generally include a stamping die which must be returned to an ink recharging position engaging a supply of ink to assure that a clear imprint is placed on the workpiece in a reliable manner.

While a printer such as disclosed in U.S. Pat. No. 4,718,341 works quite satisfactorily with respect to reliability and marking, it requires a significant amount of downtime in applications which require relatively frequent changes in the color or type of ink used or when the ink pad becomes in need of replacement for any other reason.

In prior contact stamping devices of this type, the whole ink supply assembly is required to be removed in order to implement a change of the color or the type of ink for any reason and then repositioned on the machine. Then it must again be attached to the frame and precisely registered in a proper sealed relationship with the stamping die assembly to avoid poor marking performance and to prevent dry out of the ink supply during non-use. This time consuming procedure results in costly downtime which limits production capacity of the line. If this time-consuming procedure is not done properly, poor quality marking may occur and result in further lost production time while corrective procedures are carried out.

BRIEF DISCLOSURE OF INVENTION

The present invention relates generally to high speed, high volume contact ink stamping devices which are adaptable to volume production lines for marking various parts or subassemblies or product packages. In particular, the present invention relates to those contact ink printers having a reciprocating stamping device movable between an ink recharging position and a stamping or marking position and which include an improved ink reservoir assembly constructed to permit changing of the ink supply pad as needed in a efficient and conveniently fast manner.

In a reliable, high speed contact ink stamping device of the type referred to herein, the maintenance of a sealed relationship between the stamping die assembly and the ink supply mean is important to prevent drying out of the ink pad during periods of non-use. However, such sealed contact requires rather precise alignment between the ink reservoir assembly and the stamping die. A contact ink printer which effectively provides such alignment is disclosed in my prior U.S. Pat. No. 4,718,341.

The present invention is characterized by an ink supply reservoir assembly which includes a mounting bracket and a removably mounted ink pad holder and ink supply bottle or reservoir. The ink pad holder and ink supply bottle are constructed to cooperate with the bracket to permit simple, fast and efficient change of the ink supply to the stamping die without disturbing the original precisely registered position between the bracket and the stamping die assembly. This is accomplished by providing the bracket with a recess for removably accepting the ink pad holder in which an ink pad is disposed. Upon mounting the ink pad holder into the recess, the ink pad is disposed adjacent to an access opening in the bracket which is surrounded by an elastic seal which is sealingly engaged by the periphery of the stamping die assembly while the printing surface engages the ink pad to be re-charged with ink.

The bracket and its elastic seal surrounding the access opening are separable from the ink pad holder and supply bottle, so that the latter may be removed and quickly replaced without any change of position of the bracket and its seal.

This construction permits the user to easily and quickly switch one ink pad holder and supply bottle combination for another to change the color or type of ink or to change the ink pad with minimum downtime and without risk of losing the established registered position with the stamping die.

In field operations wherein various marking runs of workpieces require different color indicia or grades of ink, the savings in time compared with the prior art is very dramatic. Such time saving is further enhanced by the fact that the chance for human error is essentially eliminated with respect to re-establishing the desired registered, sealed position with the stamping die.

Figure 1:
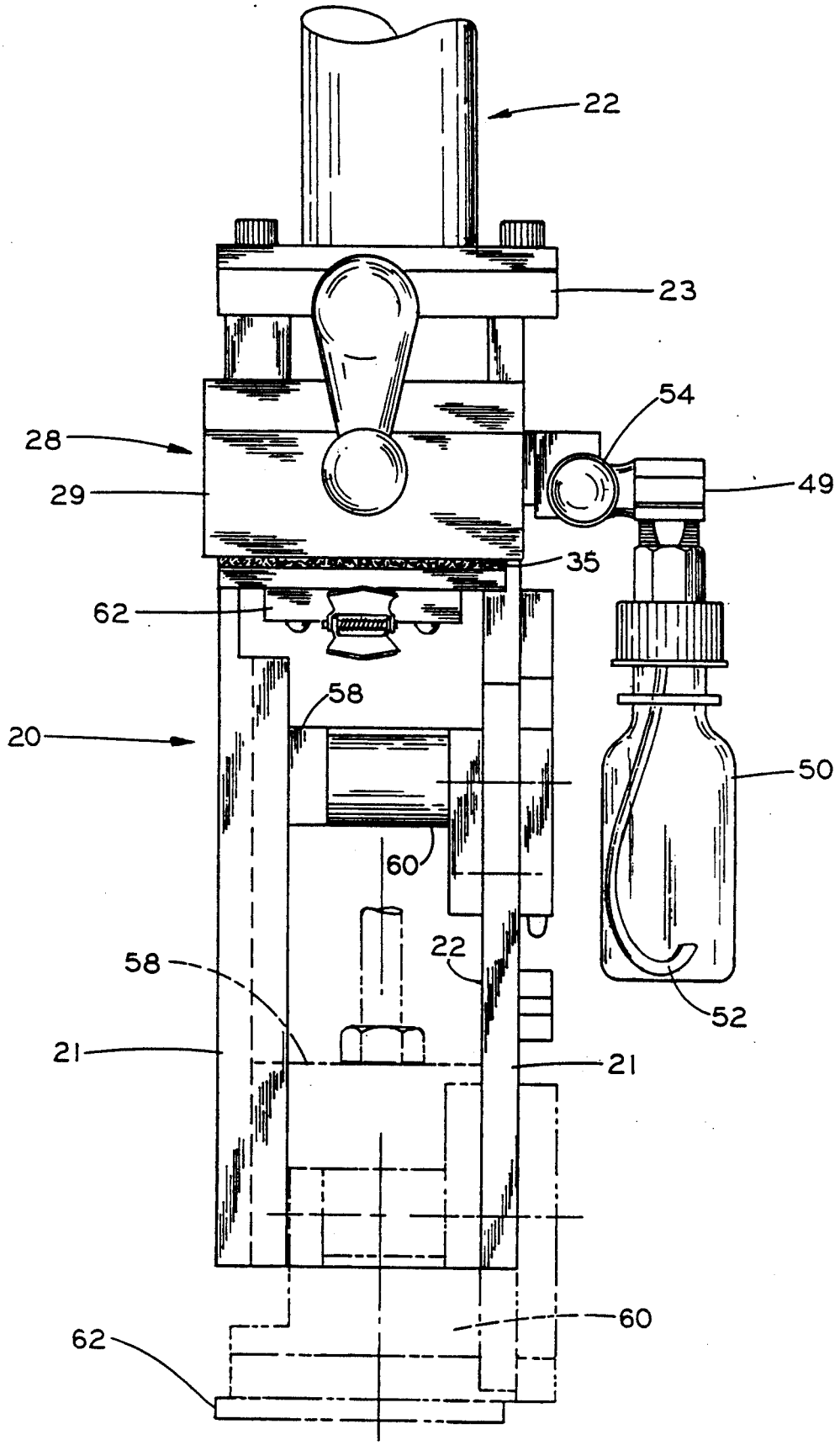
FIG. 1 is a front elevational view of a contact ink stamping apparatus which includes the novel ink supply assembly constructed in accordance with the present invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art.

DETAILED DESCRIPTION

Figure 2:
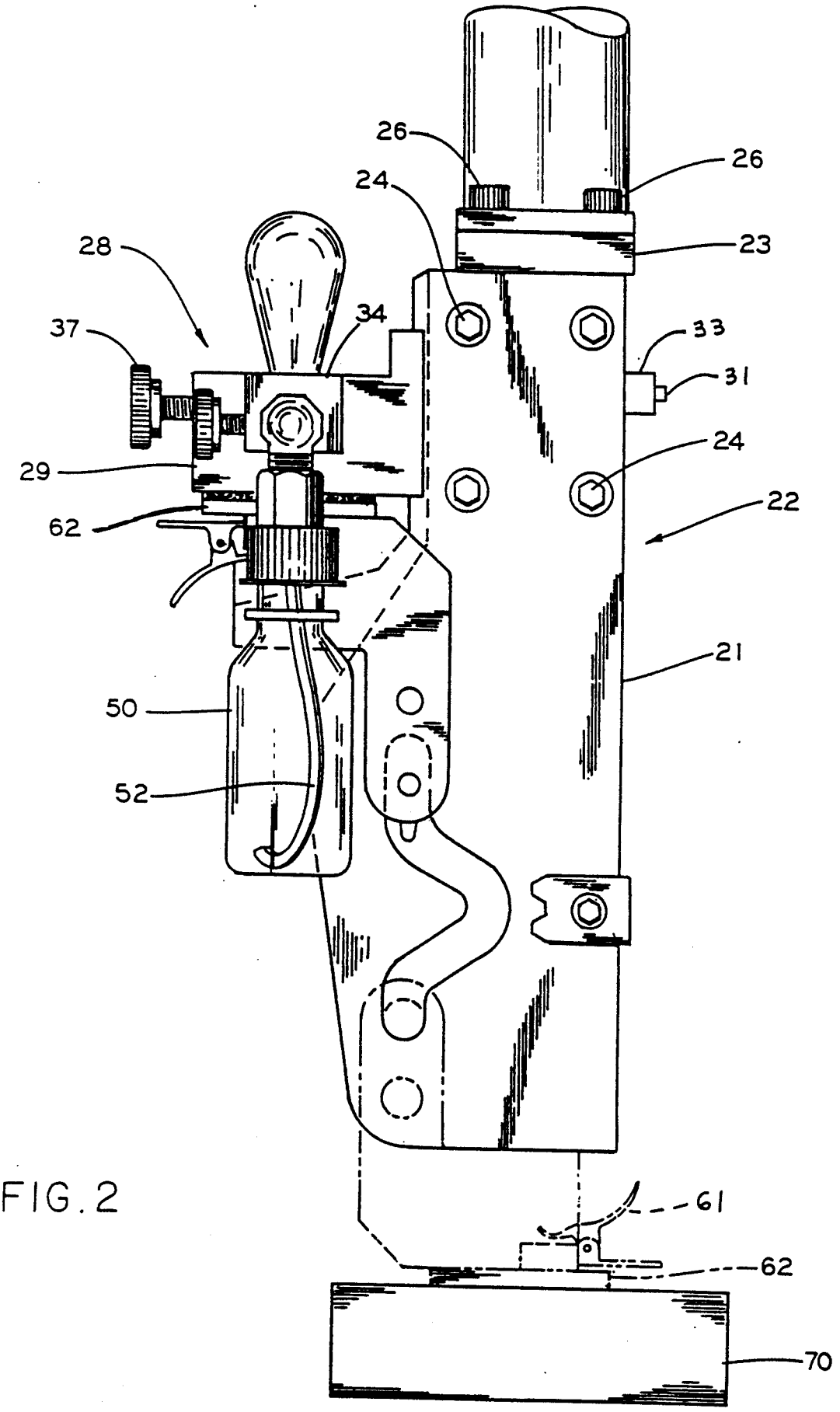
FIG. 2 is side elevational view of the apparatus shown in FIG. 1.

A contact ink stamping apparatus provided with an improved ink re-charging supply assembly constructed in accordance with the present invention is shown in FIGS. 1 and 2. For illustrative purposes, the contact stamping device shown is essentially identical to that shown and described in my prior patent, U.S. Pat. No. 4,718,341, except a it relates to the construction of the novel ink re-charging assembly which replaces the ink supply member shown in that patent. In a fully assembled condition, the stamping apparatus shown in FIG. 1 functions essentially identical to that described in U.S. Pat. No. 4,718,341 with regard to the movement and operation of the stamping die between the ink re-charging position and the stamping position wherein indicia is printed on a workpiece.

Therefore for the purposes of brevity, the ink stamping apparatus and its functions will be described in more general terms herein as one skilled in the art referencing the above-identified patent will be sufficiently informed and understand the operation thereof in connection with the present invention disclosed herein.

With reference to FIGS. 1 and 2, the contact ink stamping apparatus includes a vertically extending base or frame means, indicated generally at 20 and includes side walls members 21. A conventional cylinder and piston assembly, partially shown and indicated generally at 22, is conventionally mounted on the top of frame means 20.

Cylinder and piston assembly 22 includes a mounting block 23 fixed in position on the upper portion of frame means 20 by threaded fasteners such as 24 and 26.

An ink re-charging assembly indicated generally at 28 and constructed in accordance with the present invention includes an ink re-charging bracket member 29 which is fixed to the frame means via a pair of machine screws such as 31, which pass through holes in a strap member 33 extended across the side walls 21 of frame 20. Screws 31 are threadably received by threaded holes provided in bracket member 29 as described later herein. Upon positioning the bracket 29 and its seal 35 in position relative to the stamping die assembly, screws 31 may be tightened to fix bracket 29 into the desired sealed relationship relative to the stamping die.

Figure 3:
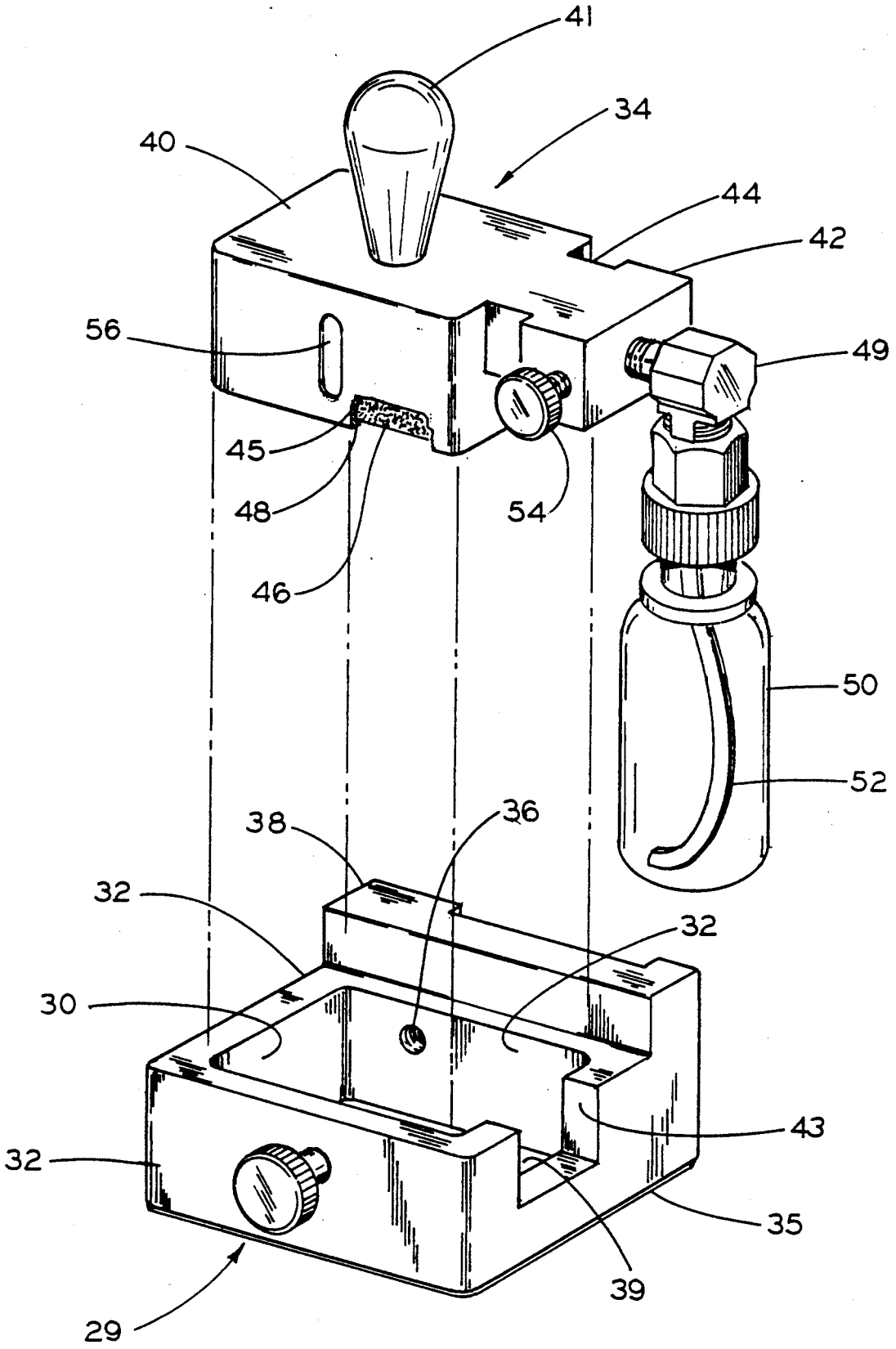
FIG. 3 is a partial perspective view of the apparatus shown in the preceding figures illustrating the components of the novel bracket and ink pad holder assembly in exploded relationship apart from the remainder of the ink stamping apparatus and illustrating the position of the ink pad in the ink pad holder in a partial break away view of one wall of the holder.
Figure 4:
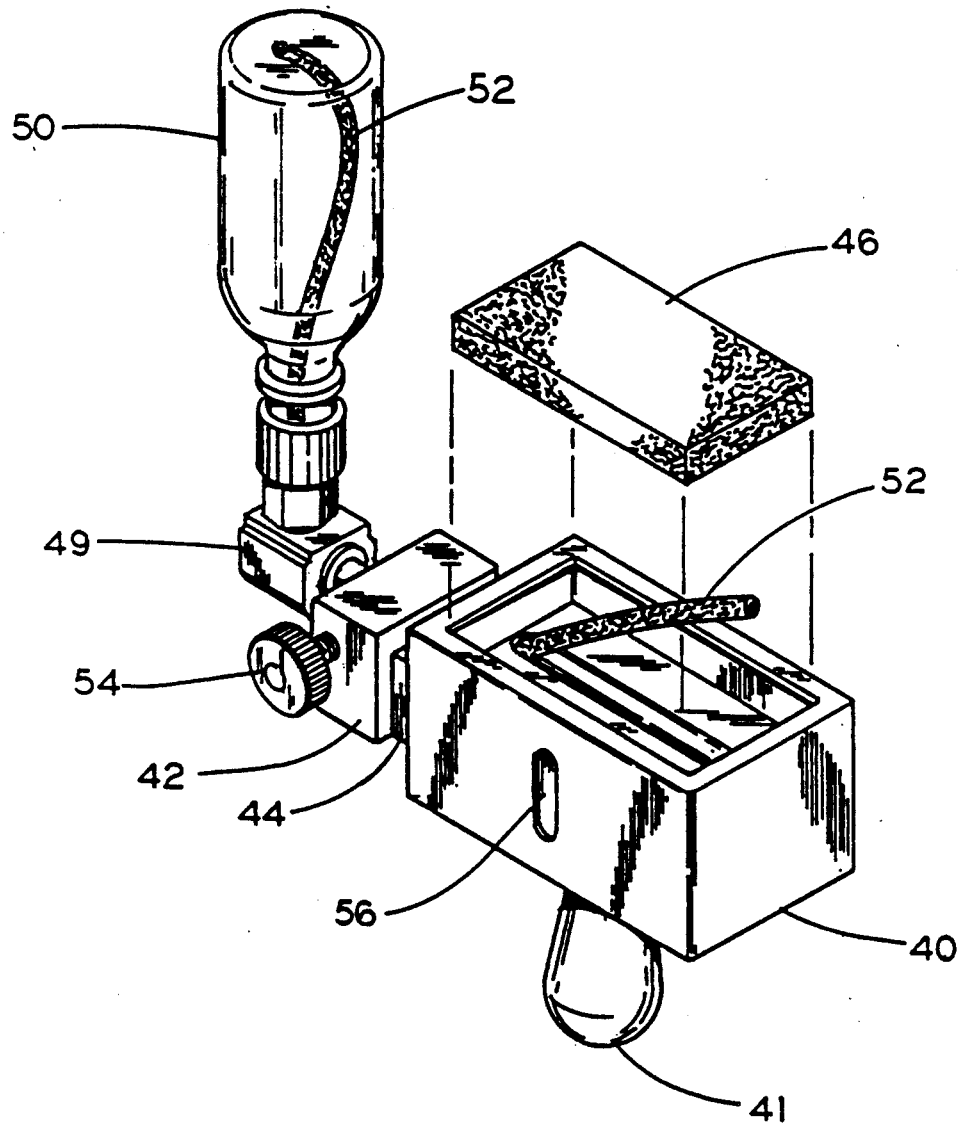
FIG. 4 is a perspective view of the ink pad holder shown in FIG. 3 with the ink pad shown in exploded relationship to the holder.

With reference to FIG. 3, bracket member 29 includes a top and bottom opening, 30 and 39, formed by surrounding side walls 32 which are adapted to slideably receive an ink pad holder component, indicated generally at 34, in a relatively close fitting relationship.

The cavity formed between said side walls 32 and the top and bottom openings is configured to wholly receive ink pad holder member 34. The bottom opening 39 is surrounded along its lower edge by a resilient gasket or seal 35 fixed thereto by a suitable adhesive. The opening 39 is sized to accept the working surface of a die stamp assembly which carries a die stamp working or printing surface.

A pair of horizontally spaced threaded holes, such as at 36, are provided in the rear wall 32 and receive the screws 31, as described earlier herein, to accomplish the mounting of bracket 29 to the frame. Other conventional means and well-known methods could be employed to adjustably mount bracket 29 in the desired position without departing from the spirit of the present invention.

Preferably the rear wall 32 is provided with an upwardly extended flange-like portion 38 and a thicker lower portion to provide additional rigidity. The increased thickness merely serves to provide greater depth to the threaded holes 36 to allow greater threaded engagement for screws 31.

Ink pad holder 34 includes a generally rectangular block-like portion 40 and a neck portion 42 provided with a narrowed section 44.

Block-like portion 40 is provided with a bottom surface having an ink pad receiving recess 45 configured to receive a conventional ink pad 46, preferably conventionally formed of an absorbent flexible material. Recess 45 includes a surrounding, relatively thin lip portion 48 which serves to retain ink pad 46 within the confines of recess 45, yet permitting access to the major portion thereof through the outwardly facing portion of the recess.

Ink pad 46 is sized to conform snugly within recess 40 and is inserted wholly therein by urging the outer edges or periphery thereof past the lip portion 48.

A supply of ink is conventionally provided to the ink pad via a passageway, not shown, which is conventionally drilled or cast through neck portion 42 and into block portion 40 in communication with recess 45. A conventional elbow fitting 49 is extended into passageway and is conventionally threadably connected to an ink bottle or container 50. An absorbent wick 52, which may consist of the same material as ink pad 46, is extended from bottle 50 through the fitting 49 and the ink passageway to a position within recess 45 in contact with the upper surface of ink pad 46. This provides a constant ink supply to pad 46 from bottle 50 via capillary action through the wick 52.

This form of communication of ink from the supply bottle to the ink pad is identical to that shown in my prior patent U.S. Pat. No. 4,718,341 and has been used in other prior art contact ink stamping devices.

The opening to the drilled passageway may be threaded, if desired, to receive fitting 49, however, it is preferred to provide a set screw, such as 54, mounted in a threaded hole which intersects the drilled passageway to secure fitting 49 in a very easily removable fashion.

As best seen in FIG. 3, narrowed portion 44 of neck portion 42 is configured to be received in a cut-out portion or notch 43 provided in one of the side walls 32 of bracket member 29. Preferably, the depth of ink pad holder 34 within bracket 29 is releasably fixed in an adjustable manner by a conventional thumb screw 37 mounted in a thread bore, not shown, provided in wall 32 of bracket 29.

A slight vertical groove 56 is provided in the front wall of holder 34 to receive the end of set screw 37 in force transmitting engagement to releasably fix holder 34 in a selected position. Any metal deformation which might occur is confined to groove 56 and therefore will not interfere in the close-fit relationship between the walls of bracket 29 and ink pad holder 34. Preferably a clearance exists between narrowed portion 44 and the bottom of notch 43 when holder 34 is initially mounted in bracket 29.

The vertical extent of groove 56 permits a sufficient degree of vertical adjustment of the depth of holder 34 within bracket 29 to provide for fine adjustment of the position of ink pad 46 relative to the fixed position of the stamping die disposed in the ink recharging position. After repeated contact, ink pad 46 may become slightly compacted. In this event, lowering of holder 34 becomes desirable to adjust the position of ink pad 46 to assure the stamping die continues to make good contact with ink pad 46 to receive sufficient ink to form a clear, strong mark.

Referring again to FIGS. 1 and 2, a slide block 58 is mounted to the lower end of the piston of cylinder and piston assembly 22 in a conventional manner and includes vertically extending ribs slideably mounted in vertical tracks provided on the opposing inner surfaces of walls 21 such as described in U.S. Pat. No. 4,718,341. A pivot block 60 carries a die stamp assembly 62 provided with a working surface carrying the indicia desired to be printed on the workpiece.

Pivot block 60 and its operation are fully described in my U.S. Patent identified above and incorporated by reference herein and therefore will not be described in detail. However, the result of such construction provides that the die stamp assembly 62 having its working surface carrying indicia, not shown, are caused to reciprocate between an ink charging position and a printing position. In many applications it is desirable to provide a removable mounted die stamp carrying printing indicia to the die stamp assembly 62 such as using a releasable clamp holder fixed to a removable die stamp such as schematically represented at 61. However, such construction is well-known in the prior art and is not described herein. The ink charging position is defined with the die stamp assembly and its working surface disposed in contact with ink pad 46 and with the periphery of the die stamp assembly 62 disposed in sealed engagement with gasket 35. The printing position is shown in ghost lines in FIGS. 1 and 2. The die stamp assembly 62 is pivoted 180 degrees during its travel between these two positions to reverse the working surface accordingly between the ink recharging position and the stamping position engaging a workpiece, such as at 70.

As the die stamp assembly 62 is actuated to reciprocate between these described positions, the construction of the stamping apparatus, as disclosed in U.S. Pat. No. 4,718,341, provides for the stamping surface to be located in a precise parallel position to the ink pad 46 and the workpiece 70 to assure a clear and complete print is made.

As previously mentioned herein, this parallel position with respect to the ink re-charging assembly 28 and particularly to the gasket 35 and ink pad 46 is desirable to assure the working surface carrying indicia receives a complete supply of ink on each cycle of die stamp assembly 62 and also to assure that a good seal is formed between the die stamp assembly and gasket 35 to prevent drying out of ink supply during periods of non-use. If the registry between die stamp assembly and gasket 35 is not sufficient to form a good seal, the quick drying ink used will dry in the ink pad during periods of non-use. Then start-up operations are unnecessarily delayed because the ink pad and, during longer periods, the supply bottle may become dry and require re-charging.

Using the prior art construction, such as shown in U.S. Pat. No. 4,718,341, any condition requiring recharging or changing of the ink pad 46 required that the whole ink reservoir assembly be removed from the frame. This represented a relatively time consuming process. Further, such removal necessarily dictated that the whole reservoir assembly had to be replaced on the frame and carefully readjusted to properly register with the die stamp assembly in the recharging position to re-establish the desired parallel and sealed relationship.

In some applications, changes of ink color or type are relatively infrequent and the time consumed in such procedure is therefore not as bothersome. However, certain applications require frequent changes in the color or type of ink employed and particularly emphasize any time consuming inefficiency in making such changes. Prior to the present invention, such applications often dictated the use of a very expensive, highly sophisticated printing apparatus capable of changing ink color or types quickly to reduce any lost production time.

However, utilizing the apparatus of the present invention eliminates any such disadvantage of the relatively inexpensive contact ink printing apparatus of the type disclosed herein. Since the ink pad holder 34 is separable from bracket 29 and easily removed, the user may maintain a supply of several such holders 34, the associated ink pads 46 and bottles 50 to permit quick replacement of another color or type of ink as required in a given application. Such components are, in themselves, relatively inexpensive.

To implement a change to a different color or type of ink, the user merely loosens thumb screw 37 and lifts ink pad holder 34 upwardly using knob 41 conventionally attached to the top of block portion 40. Bracket 29 remains in its original registered position and is undisturbed during any change of ink pad holder 34.

Another identically constructed ink pad holder 34 carrying a new ink pad 46, wick 52 and supply bottle 50 which is charged with the desired type of ink, is quickly replaced by inserting it into the top opening 30 of bracket 29 as previously described. Holder 34 is lowered into bracket 29 to the desired depth associated with full contact between ink pad 46 and working surface of die stamp assembly 62. This may be easily accomplished by lowering holder 34 into bracket 29 while die stamp assembly 62 is fully seated in its re-charging position in sealed engagement with gasket 35. The user then simply tightens thumb screw 37 to fix this position wherein the working surface of die stamp assembly 62 fully contacts ink pad 46. Any further fine adjustment of the position of holder 34 is accomplished as previously described.

As is well-known in the trade, it is desirable to charge or saturate ink pad 46 initially directly by pouring ink from bottle 50, or another source of ink, on ink pad 50, prior to placing the holder 34 within bracket 29. Ink pad 46 will maintain a sufficient charge of ink via capillary action through wick 52 inserted into ink bottle 50. From the foregoing description, it should be readily appreciated that the apparatus of the present invention provides a contact ink stamping apparatus capable of handling a variety of applications, particularly those requiring frequent changes in the color or type of ink required, with ease and a minimum loss of production efficiency.

While certain preferred embodiments of the present invention have been disclosed in detail, it is to be understood that various modifications may be adopted without departing from the spirit of the invention or scope of the following claims.

I claim:

1. In an automatic ink stamping apparatus of the type provided with a die stamp movably mounted on a support base for reciprocating travel between an ink recharging position and a stamping position, the combination of: an ink recharging assembly including (a) a mounting bracket fixed to said support base and defining said recharging position in association with a limit of travel of said stamping die, said bracket including a die stamp access bottom opening and sealing means disposed in surrounding relationship to said die stamp access opening and a top opening having a closely similar configuration to said die stamp access opening; (b) an ink pad holder removably mounted within said bracket through said top opening and having side and top walls and a bottom face provided with an ink pad receiving recess conformed generally to the configuration of said die stamp access opening in said bracket; (c) an ink pad supportably mounted within said recess to engage a working surface of said die stamp when said die stamp is in said recharging position and engaging said sealing means surrounding said die stamp access opening; and (d) an ink supply container mounted directly to said ink pad holder and extending outwardly from said mounting bracket.

2. The apparatus defined in claim 1 wherein said bracket includes side walls defining said top opening and said side walls including a notch and said ink pad holder includes an outwardly extending neck portion configured to be received in said notch, said ink supply container being mounted to said neck portion and means to releasably fix said ink pad holder within said bracket.

3. A contact ink stamping apparatus comprising, in combination:

(a) a support base;

(b) an ink die stamp provided with a planar printing surface and mounted on said base for reciprocation between an ink recharging position and a stamping position spaced from one another along a predetermined line of travel;

(c) an ink re-charging assembly including a mounting bracket member fixed to said base means and provided with a top and bottom opening having substantially similar configurations surrounded by side walls and an ink pad holder member removably mounted between said side walls of said bracket through said top opening of said bracket, said bottom opening of said bracket member defining a plane parallel to said planar printing surface and provided with resilient sealing means conformed to sealingly engage the periphery of said die stamp when said die stamp is in said ink re-charging position;

(d) said ink pad holder member including side walls configured to closely fit within the side walls of said bracket, a bottom surface provided with an ink pad receiving recess and an ink pad disposed within said recess and outwardly exposed for access through said bottom opening of said bracket;

(e) and means associated with the side walls of said ink pad holder member and said side walls of said bracket member to releasably fix said ink pad holder member within said bracket member to dispose said ink pad in an engagable relationship to said planar printing surface of said die stamp when said die stamp is in said re-charging position.

4. The apparatus defined in claim 3 wherein said last mentioned means includes a member threadably received by a wall of said bracket member and movable into force transmitting engagement with a side wall of said ink pad holder.

* * * * *